US005201304A

United States Patent [19]

Rezmer

[11] Patent Number: 5,201,304

[45] Date of Patent: Apr. 13, 1993

[54] CENTER SHOT GAUGE

[75] Inventor: Leonard D. Rezmer, Montrose, Mich.

[73] Assignee: Gametracker, Inc., Montrose, Mich.

[21] Appl. No.: 766,621

[22] Filed: Sep. 26, 1991

[51] Int. Cl.[5] ..... F41B 5/00

[52] U.S. Cl. ..... 124/24.1; 124/25.6; 124/87; 124/88

[58] Field of Search ..... 124/88, 87, 86, 44.5, 124/24.1, 90, 25.6, 23.1; 33/265

[56] References Cited

U.S. PATENT DOCUMENTS

| | | | |
|---|---|---|---|
| 3,488,853 | 1/1970 | Altier | 124/87 X |
| 3,561,418 | 2/1971 | Fredrickson | 124/87 X |
| 4,669,194 | 6/1987 | Amacker | 124/87 X |
| 4,911,137 | 3/1990 | Troncoso | 124/88 X |
| 4,917,072 | 4/1990 | Chang | 124/87 X |
| 5,040,300 | 8/1991 | Sheffield | 124/87 X |
| 5,060,627 | 10/1991 | Fenchel | 124/40 X |

*Primary Examiner*—Peter M. Cuomo
*Attorney, Agent, or Firm*—Weintrab, DuRoss & Brady

[57] ABSTRACT

An apparatus to facilitate aiming of a compound bow includes an indicator to delineate the center line of the bow and a measuring scale to guide arrow placement with respect to the center line. In a preferred embodiment, the center line indicator includes two shafts for attaching to allen screw heads provided on the bow, and one more elastic members which interconnect the shafts.

5 Claims, 2 Drawing Sheets

FIG 1
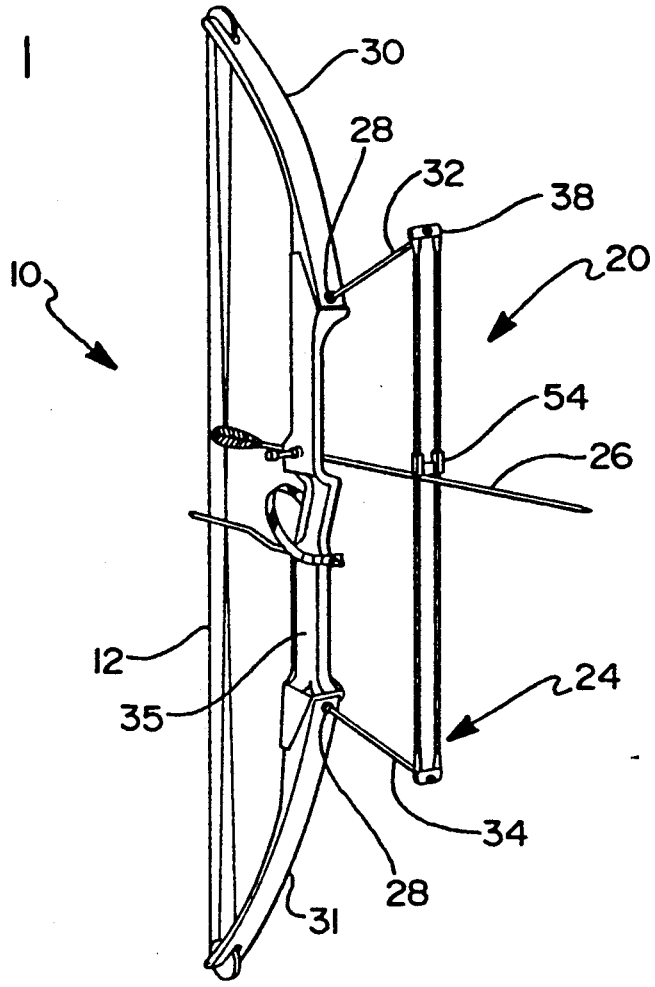
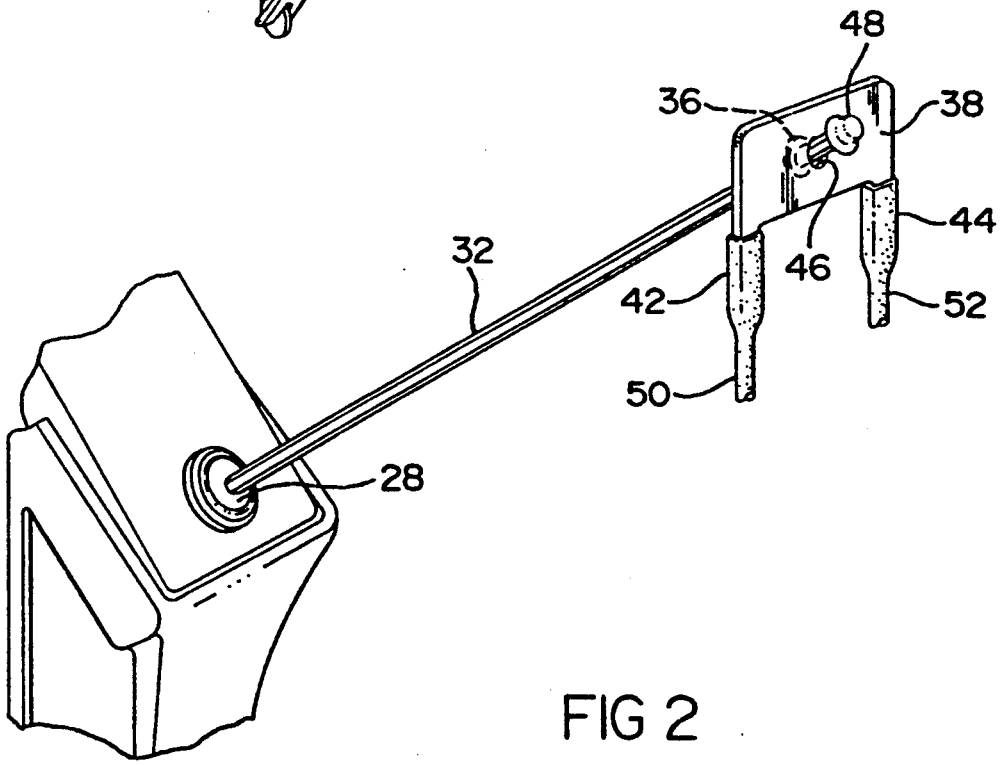
FIG 2

FIG 4
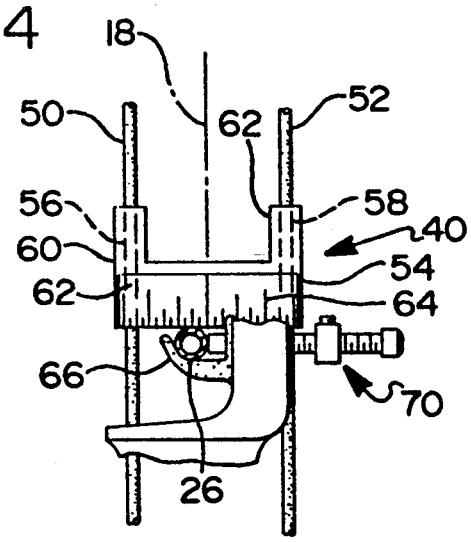
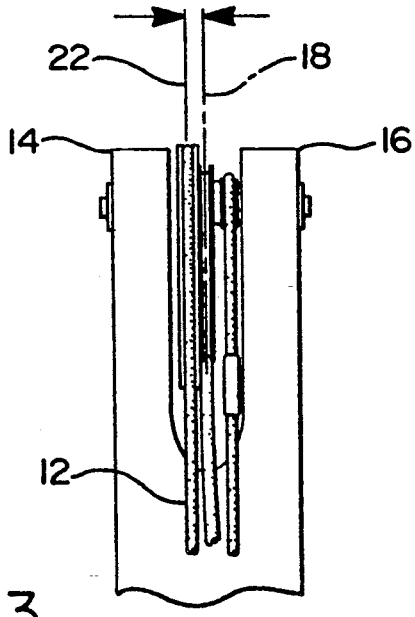
FIG 3

CENTER SHOT GAUGE

BACKGROUND OF THE INVENTION

1. Field of the Invention

The present invention relates to an apparatus which is usable for assisting a bow hunter in lining up an arrow to shoot it in a straight line at a target. More particularly, the present invention relates to an apparatus which assists a bow hunter lining up an arrow shaft with the bow string of a compound bow so that the arrow will travel in a true manner towards a target.

2. Prior Art

U.S. Pat. No. 4,116,194 issued Sep. 26, 1978 discloses a sighting device for use on a bow in which an eye piece is inserted into the center of the bow string and is connected by a flexible tube to a block which is attached to the bow. The bow string is pulled back until a sighting member is visible through the eyepiece. Although the device of the '194 patent provides some assistance in aiming an arrow, no provision is made in this patent for accommodating for placement of the bow string of a compound bow being off of the center line of the bow.

A need exists in the archery art for an arrow rest calibrating device for use with a compound bow which will help a bow hunter adjust an arrow rest to compensate for the amount which the bow string of a compound bow is off of the center line of the bow.

SUMMARY OF THE INVENTION

The present invention provides a measuring apparatus for attaching to assist a bow hunter in presenting the position of an adjustable arrow rest of the aiming a compound bow, the bow having a center line. The apparatus hereof indicates the location of an arrow shaft relative to the center line of the bow. The apparatus hereof also provides a measuring scale to allow a user of the bow to move the arrow shaft out of alignment with the center line of the bow the same distance that the bow string is off of the center line of the bow. This adjustment of the arrow shaft is necessary in order to help a user of the bow calibrate the arrow rest for a straight and true flight of arrows from the bow.

An apparatus in accordance with the present invention, generally, comprises:

means attachable to the bow for indicating the center line of the bow; and, means for measuring the position of an arrow shaft with respect to the center line of the bow when the arrow is mounted on the bow.

In a particularized embodiment hereof, the center line indicating means comprises:

(a) a first shaft having a geometric cross-section for attaching to the bow at the center line thereof;

(b) a second shaft having a geometric cross-section for attaching to the bow at the center line thereof; and, (c) means for interconnecting the first and second shafts.

For a more complete understanding of the present invention, the reader is referred to the following detailed description section, which should be read in conjunction with the accompanying drawings. Throughout the following description and in the drawings, like reference numbers refer to like parts throughout the several views, in which:

BRIEF DESCRIPTION OF THE DRAWINGS

FIG. 1 is a three-quarter perspective view of a compound bow having the apparatus hereof mounted thereto;

FIG. 2 is a cutaway perspective detail view of a portion of the bow and apparatus shown in FIG. 1;

FIG. 3 is a rear elevational view of an upper end of the bow of FIG. 1; and, FIG. 4 is a rear elevational view of the arrow position indicator scale of the present apparatus, showing a portion of the bow cut away and showing an arrow in cross-section.

DETAILED DESCRIPTION OF THE PREFERRED EMBODIMENT

Referring now to the drawings, a compound bow is shown generally at 10 in FIG. 1, having an apparatus in accordance with the present invention mounted on the bow 10 and indicated generally at 20. As those familiar with compound bows will realize, and as is shown with some detail in FIG. 3, a compound bow involves the use of pulleys attached to opposite ends of the bow and a bow string which is wrapped around those pulleys to obtain greater launching force when an arrow is released from the bow, than is obtainable using an ordinary bow. The placement of the pulleys and associated mounting hardware on the bow ends normally necessitates that the bow string 12 which is used for mounting and shooting arrows be located off of the center line of the bow. The term "center line" of the bow, as used herein, is intended to mean a line which is taken along a plane which bisects the bow in a substantially symmetrical manner along the longitudinal axis thereof, disregarding the fact that the central gripping portions of the bow is not symmetrical. A central plane bisecting the portions of the bow which are symmetrical will define the center line. The center line, should, preferably, be parallel to the bow string 12 to which arrows are mounted. The center line of the bow can be approximated at either end thereof by measuring the total width of the bow and dividing that total distance in half. The width of the bow is the distance between opposite sides 14, 16 of the bow adjacent an end thereof, as shown in FIG. 3. The center line of the bow is shown in FIG. 3 at 18. As is also shown in FIG. 3, the bow string 12 which is used to mount an arrow thereto, is displaced or offset from the center line of the bow by a certain distance. A line indicating the center of the bow string 12 is shown in FIG. 3 at 22, to the left of the center line 18.

Since the bow string 12 is offset from the center line 18 of the bow, if an arrow is to be properly aimed so as to fly straight and true when released from the bow, then the arrow shaft must be displaced off of the center line of the bow the same distance and in the same direction away from the center line that the bow string is displaced from the center line. Prior to the present invention, it is the Applicant's understanding that this correction was made by eye and by guess or estimate. Such a visual estimate provides inconsistent results.

The present invention provides a measuring apparatus for attaching to a compound bow having a center line, to facilitate aiming of the bow. The apparatus 20 of the present invention includes means 24 for indicating the center line of the bow, the indicating means being attachable to the bow; and means 40 for measuring the position of an arrow shaft 26 with respect to the center line 18 of the bow 10 when the arrow 26 is mounted on the bow.

As will be appreciated by those having knowledge of compound bows, it is standard for a compound bow to have allen-head limb bolts 28 attaching the outer limb sections 30, 31 which are normally made of laminated wood plastic or fiberglass, to the central hand grip section or riser 34, which is normally made of metal or wood. These limb bolts 28 are disposed along the center line 18 of the bow 10. The opening in each of the limb bolts 28 is normally of a geometric cross-section, which is most commonly hexagonal. Accordingly, the present apparatus 20 of the invention provides a first shaft 32 having a geometric cross-section which fits securely in the opening of the upper limb bolt 28 shown on the upper half of the bow in FIG. 1, and a second shaft 34 having a geometric cross-section for insertion into the opening of the lower limb bolt 28 at the lower section of the bow 10 as shown in FIG. 1. Preferably, the first and second shafts 32, 34 have a hexagonal cross-section, as shown.

A friction washer 36 having tabs extending inwardly in the center thereof, to frictionally engage the shaft, is slid over each of the first and second shafts 32, 34 to provide a backstop for each one of a pair of substantially identical support members 38. Each of the support members 38 is formed from a rigid material such as a metal or a strong, durable plastic material. Each support member 38 has a pair of fingers 42, 44 integrally formed therewith and extending outwardly therefrom. Each of the support members 38 further has a central hole 46 formed therethrough to allow passage therethrough of the associated shaft. An equivalent support member (not shown) could be provided which would attach directly to the shaft 32, 34. A cap nut 48 is provided on the end of each shaft 32, 34 and the interior of the cap nut 48 frictionally engages with the shaft to retain the cap nut thereon. The friction washer 36 and the cap nut 48, together, act to retain the support member 38 in place mounted on the end of each respective shaft 32, 34. It will be understood that the friction washer 36, the support member 38, and the cap nut 48 which are depicted in FIG. 2 at the end of the first shaft 32 are essentially duplicated at the end of the second shaft 34. It will therefore be understood that if the bow 10 were rotated 180° about a horizontal axis, FIG. 2 could easily represent the second shaft 34 and associated hardware as accurately as it depicts the first shaft 32 and its associated hardware.

A pair of elastic members 50, 52, which may be substantially identical rubber or elastomeric hollow tubes, are stretched over the ends of the fingers 42, 44 of each of the support members 38 in order to interconnect the support members 38 as shown in FIG. 1. The first and second shafts 32, 34, the two support members 38, and the elastic members 50, 52 together with the associated friction washers 36 and cap nuts 48 provide a means for indicating the center line of the bow, since the center line 18 of the bow will fall approximately centrally between the two elastic members 50, 52 at all points thereof.

An arrow position indicator 54 is generally U-shaped as shown in FIGS. 1 and 4. The arrow position indicator 54 has two hollow vertical bores 56, 58 formed through the upright bars 60, 62 thereof on each side of the arrow position indicator 54. The elastic members 50, 52 pass through the hollow bores 56, 58 of the arrow position indicator 54. The arrow position indicator 54 is freely slidably movable on the elastic members 50, 52. A measuring scale 62 is affixed to the side of the arrow position indicator 54 which faces a user of the bow. This measuring scale 62 has distance indicia 64 marked thereon. This indicia 64 may be gradated in inches, millimeters, or may be in other arbitrary markings. The center line 18 of the bow is, preferably, marked prominently on the measuring scale 62.

When using the apparatus of the present invention, the arrow position indicator 54 is slid upwardly on the elastic members 50, 52, and an arrow 26 is mounted on the bow string 12, and is placed in an adjustable arrow rest 66. An arrow position adjusting mechanism 70 is provided on the bow 10 to adjust the position of the arrow. Many types of arrow position adjuster are known, and the type shown in the drawing is for illustrative purposes only. The arrow position adjusting mechanism, per se, does not form a part of the present invention. The center line 18 of the bow limb is then calculated by measuring the width of the bow and dividing that number in half. The position of the bow string 12 is then measured from the near edge 14 of the bow limb, and the difference between the distance to the center line 18 and the distance to the bow string 12 is then calculated. This difference provides the measurement of the distance which the arrow shaft 26 should be moved off of the center line 18 of the bow. Appropriate adjustment is made to the arrow position adjusting mechanism 70 to line up the arrow shaft 26 with the measuring scale 62 with the arrow shaft moved the same distance away from the center line 18, and in the same direction, that the bow string 12 is away from the center line 18. Once the proper adjustment of the position adjusting mechanism 70 has been made, the apparatus 20 hereof is removed from the bow for normal use thereof. By using this method and apparatus, superior results will be obtained.

Although the present invention has been described herein with respect to a specific embodiment thereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

Having, thus, described the invention, what is claimed is:

1. An apparatus for attaching to a compound bow having a center line to assist in calibrating an adjustable arrow rest on the bow, the compound bow having a bow string which is offset from the center line of the bow, the apparatus comprising:

(a) means for indicating the center line of the bow, the means for indicating being attachable to the bow, the means for indicating being vertically disposed on the bow along the center line thereof;

(b) means for measuring the position of an arrow shaft with respect to the center line of the bow when the arrow is mounted on the bow, said measuring means being vertically movably disposed on said indicating means for movement along the center line of said bow, whereby the user of the apparatus can compensate for the bow string being offset from the center line of the bow.

2. The apparatus of claim 1, wherein the means for indicating comprises:

(a) a first shaft having a geometric cross-section for attaching to the bow at the center line thereof;

(b) a second shaft having a geometric cross-section for attaching to the bow at the center line thereof and for placement in a position which is displaced vertically from the first shaft along the center line; and (c) means for interconnecting the first and second shafts;

wherein the means for measuring is movably mounted on said interconnecting means between the first and second shafts.

3. The apparatus of claim 2, wherein the measuring means comprises a scale mountable on the interconnecting means, the scale having distance indicia thereon.

4. The apparatus of claim 1, wherein the means for measuring comprises a scale mountable on the indicating means, the scale having distance indicia thereon.

5. An apparatus for attaching to a compound bow having a center line to assist in calibrating an adjustable arrow rest on the bow, the apparatus comprising:

means attachable to the bow for indicating the center line of the bow; and means for measuring the position of an arrow shaft with respect to the center line of the bow when the arrow is mounted on the bow;

wherein the center line indicating means comprises:

(a) a first shaft having a geometric cross-section for attaching to the bow at the center line thereof;

(b) a second shaft having a geometric cross-section for attaching to the bow at the center line thereof; and means for interconnecting the first and second shafts; the interconnecting means comprising:

a first support member for attaching to the first shaft adjacent an end thereof, the first support member having two fingers extending outwardly therefrom;

a second support member for attaching to the second shaft adjacent an end thereof, the second support member having two fingers extending outwardly therefrom; and two elastic members for connecting the fingers of the first support member to the fingers of the second support member, wherein said measuring means being movably disposed on said two elastic members between the first and second shafts.

* * * * *